US008453619B2

(12) United States Patent
Marriott

(10) Patent No.: US 8,453,619 B2
(45) Date of Patent: Jun. 4, 2013

(54) HYDRAULIC ENGINE VALVE ACTUATION SYSTEM INCLUDING INDEPENDENT FEEDBACK CONTROL

(75) Inventor: Craig D. Marriott, Clawson, MI (US)

(73) Assignee: GM Global Technology Operations LLC

( * ) Notice: Subject to any disclaimer, the term of this patent is extended or adjusted under 35 U.S.C. 154(b) by 367 days.

(21) Appl. No.: 12/984,233

(22) Filed: Jan. 4, 2011

(65) Prior Publication Data

US 2012/0168654 A1 Jul. 5, 2012

(51) Int. Cl.
*F02D 13/04* (2006.01)
*F01L 1/34* (2006.01)

(52) U.S. Cl.
USPC ..... 123/321; 123/90.13

(58) Field of Classification Search
USPC ..... 123/321–322, 90.1, 90.12, 90.13, 123/90.38, 90.46, 90.55; 137/596
See application file for complete search history.

(56) References Cited

U.S. PATENT DOCUMENTS

| | | | | |
|---|---|---|---|---|
| 6,047,673 | A * | 4/2000 | Lohse et al. | 123/90.11 |
| 6,782,852 | B2 * | 8/2004 | Van Weelden | 123/90.11 |
| 7,309,032 | B2 * | 12/2007 | Fischer et al. | 239/585.1 |
| 7,644,688 | B2 | 1/2010 | Marriott et al. | |
| 2004/0065855 | A1 * | 4/2004 | Van Weelden | 251/30.01 |

* cited by examiner

*Primary Examiner* — John T. Kwon
*Assistant Examiner* — Johnny Hoang
(74) *Attorney, Agent, or Firm* — Harness, Dickey & Pierce, P.L.C.

(57) ABSTRACT

A hydraulic valve actuation assembly may include a housing, a piston, a supply control valve, a closing control valve, and an opening control valve. The housing may define a first fluid chamber, a second fluid chamber, and a third fluid chamber. The piston may be axially secured to an engine valve and located within the first, second and third fluid chambers. The supply control valve may control a hydraulic fluid supply to the piston. The closing control valve may be located between the supply control valve and the second fluid chamber and may control fluid flow from the second fluid chamber to the supply control valve. The opening control valve may be located between the supply control valve and the second fluid chamber and may control fluid flow from the supply control valve to the second fluid chamber.

20 Claims, 5 Drawing Sheets

HYDRAULIC ENGINE VALVE ACTUATION SYSTEM INCLUDING INDEPENDENT FEEDBACK CONTROL

GOVERNMENT LICENSE RIGHTS

The Government of the United States of America has rights in this invention pursuant to Contract No. DE-FC26-05NT-42415 awarded by the United States Department of Energy.

FIELD

The present disclosure relates to hydraulic engine valve actuation systems.

BACKGROUND

This section provides background information related to the present disclosure which is not necessarily prior art.

Internal combustion engines may combust a mixture of air and fuel in cylinders and thereby produce drive torque. Intake valves may control airflow into the combustion chamber and exhaust valves may control exhaust gas flow from the combustion chamber. Intake and exhaust valve opening may be controlled by a hydraulic actuation mechanism.

SUMMARY

An engine assembly may include an engine structure, an engine valve and a hydraulic valve actuation assembly. The engine structure may define a combustion chamber and the engine valve may be supported by the engine structure and may be in communication with the combustion chamber. The hydraulic valve actuation assembly may be supported on the engine structure and may include a housing, a piston, a supply control valve, a closing control valve, and an opening control valve. The housing may define a first fluid chamber, a second fluid chamber, and a third fluid chamber. The piston may be axially secured to the engine valve and located within the housing. The piston may include a first piston surface exposed to the first fluid chamber, a second piston surface exposed to the second fluid chamber and a third piston surface exposed to the third fluid chamber.

The supply control valve may be in communication with a first hydraulic fluid supply operating at a first pressure and a second hydraulic fluid supply operating at a second pressure less than the first pressure. The closing control valve may be located between the supply control valve and the second fluid chamber. The closing control valve may be in communication with the first fluid chamber, the second fluid chamber, and the supply control valve. The closing control valve may control fluid flow from the second fluid chamber to the supply control valve. The opening control valve may be located between the supply control valve and the second fluid chamber. The opening control valve may be in communication with the second fluid chamber, the third fluid chamber and the supply control valve. The opening control valve may control fluid flow from the supply control valve to the second fluid chamber.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
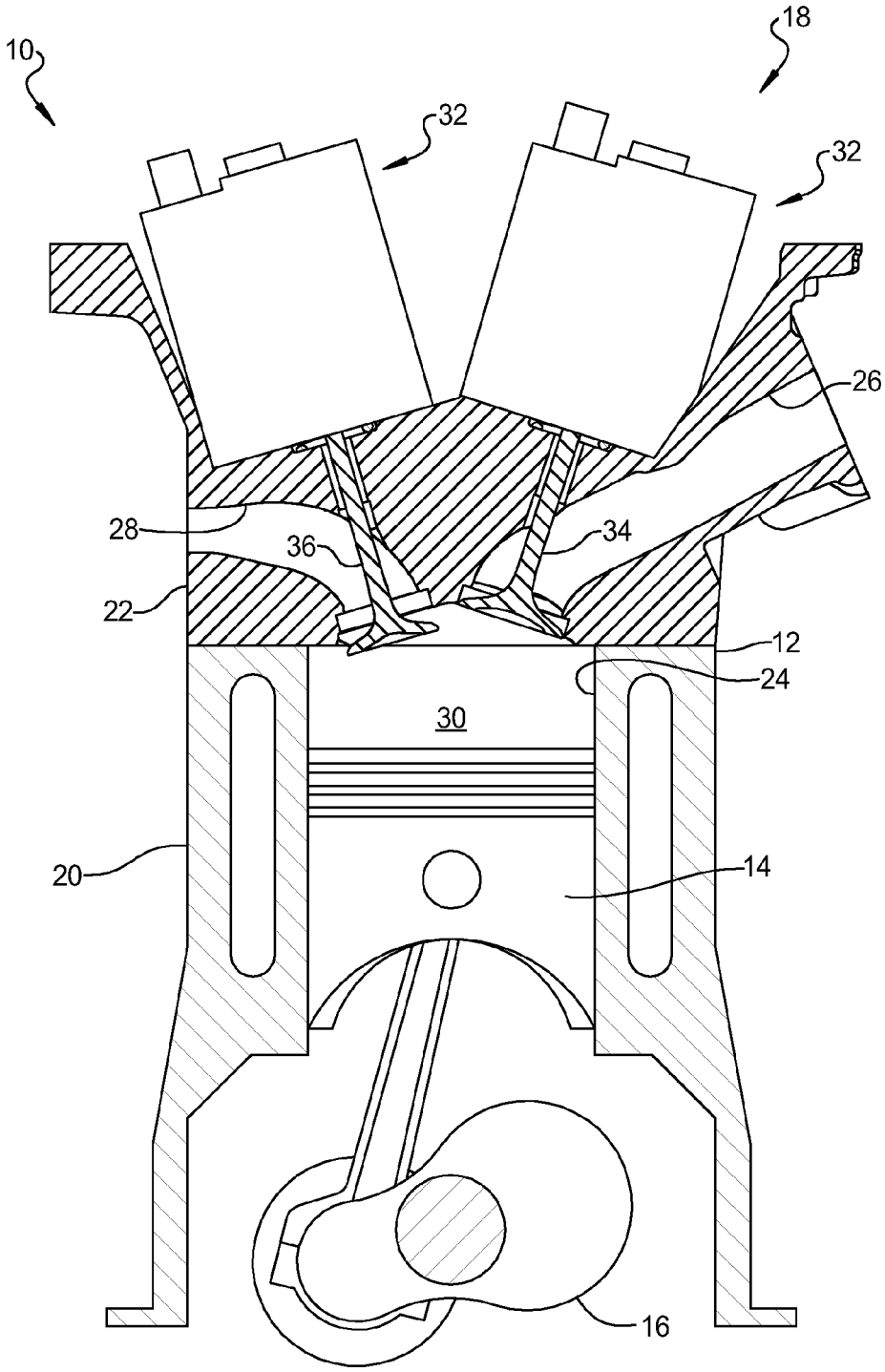
FIG. 1 is a schematic illustration of an engine assembly according to the present disclosure.
Figure 2:
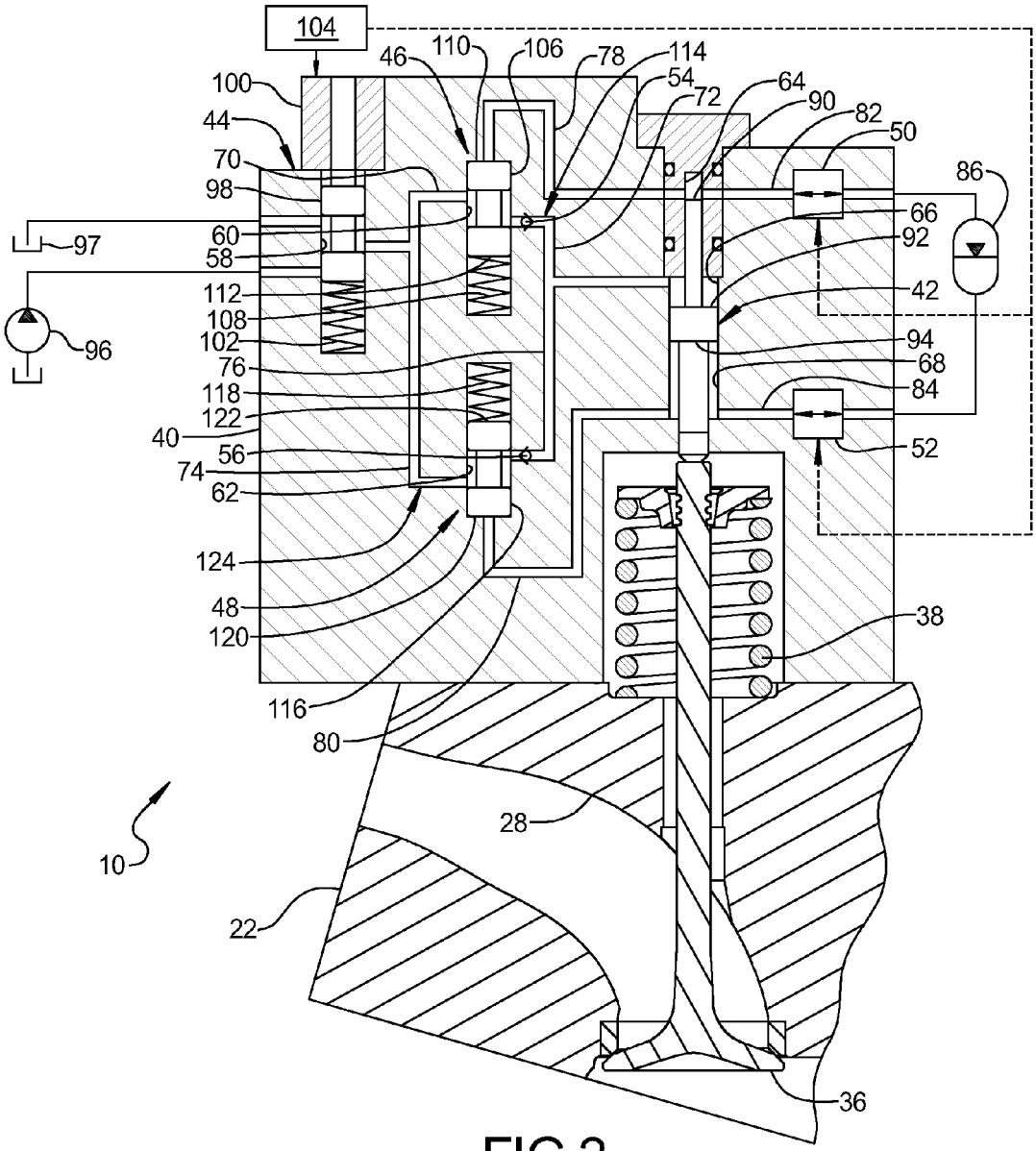
FIG. 2 is a section view of the engine assembly of FIG. 1.
Figure 3:
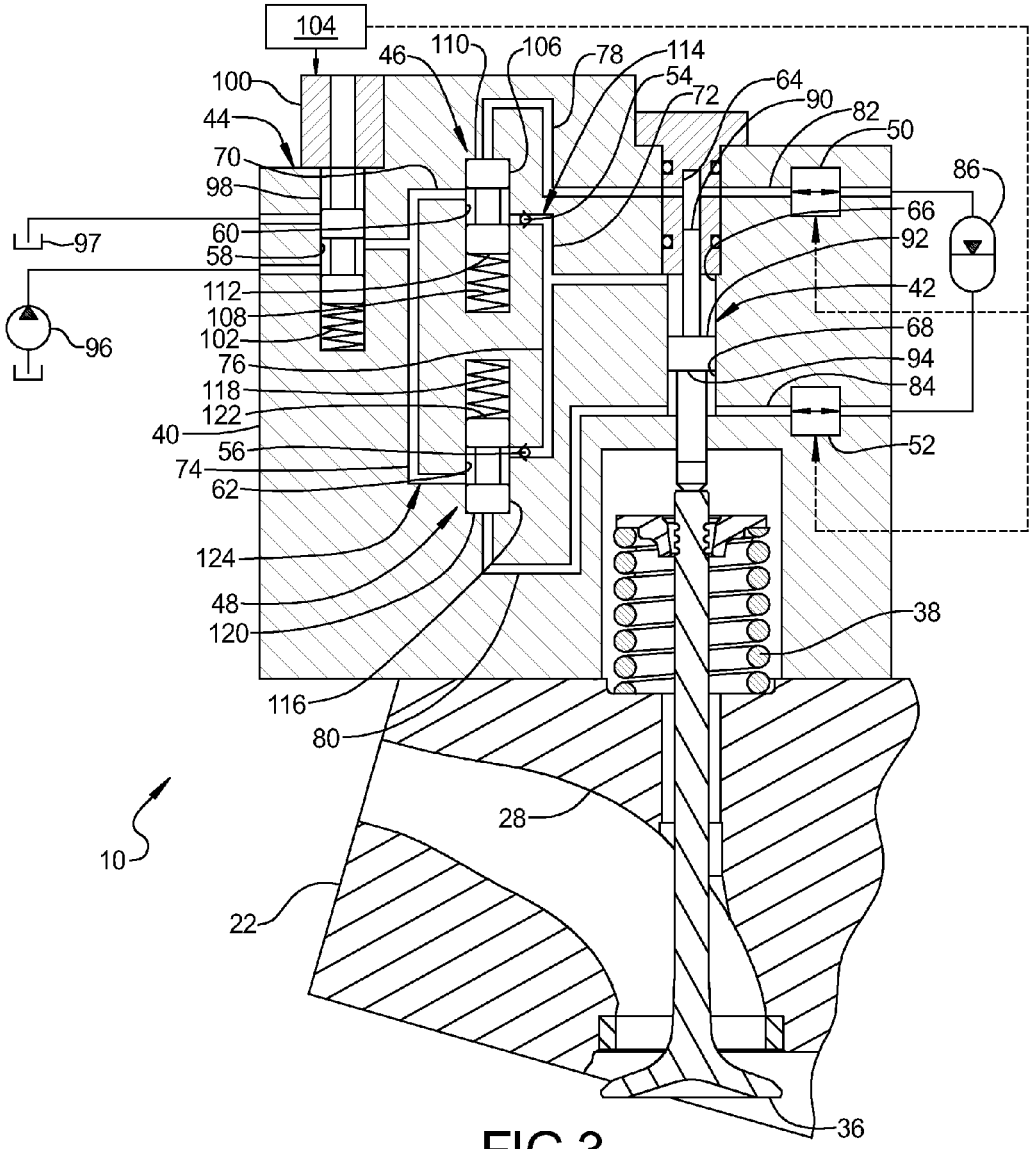
FIG. 3 is an additional section view of the engine assembly of FIG. 1.

With reference to FIG. 1, an engine assembly 10 is schematically illustrated. The engine assembly 10 may include an engine structure 12, pistons 14 (one shown), a crankshaft 16, and a valvetrain assembly 18. The engine structure 12 may include an engine block 20 and a cylinder head 22. The engine block 20 may define cylinder bores 24. The pistons 14 may be engaged with the crankshaft 16 and located within the cylinder bores 24. A single piston 14 and cylinder bore 24 are illustrated for simplicity. However, it is understood that the present disclosure applies equally to any number of piston-cylinder arrangements, as well as engine configurations including, but not limited to, inline and V-configurations.

The cylinder head 22 may be engaged with the engine block 20 and may define intake and exhaust ports 26, 28. The engine structure 12 may define a combustion chamber 30. More specifically, the piston 14, the cylinder bore 24 and the cylinder head 22 may cooperate to define the combustion chamber 30. The valvetrain assembly 18 may be supported by the engine structure 12 and may selectively provide communication between the intake and exhaust ports 26, 28 and the combustion chamber 30.

The valvetrain assembly 18 may include hydraulic valve actuation assemblies 32, engine valves 34, 36 and valve springs 38 engaged with the engine valves 34, 36 and biasing the engine valves 34, 36 to an engine valve closed position. The engine valves 34, 36 may be supported by the engine structure 12 and may be in communication with the combustion chamber 30. The engine valve 34 may form an intake valve and the engine valve 36 may form an exhaust valve. The hydraulic valve actuation assembly 32 may be the same for each of the engine valves 34, 36. For simplicity, the following description discusses the hydraulic valve actuation assembly 32 associated with the engine valve 36 (exhaust valve) with the understanding that the description applies equally to the hydraulic valve actuation assembly 32 associated with the engine valve 34 (intake valve).

With reference to FIGS. 2-5, the hydraulic valve actuation assembly 32 may be supported on the engine structure 12 and may include a housing 40, a piston 42, a supply control valve 44, a closing control valve 46, an opening control valve 48, a first vent valve 50, a second vent valve 52, a first check valve 54 and a second check valve 56. The housing 40 may define first, second and third valve housings 58, 60, 62, a first fluid chamber 64, a second fluid chamber 66, a third fluid chamber 68, first and second exhaust passages 70, 72, first and second supply passages 74, 76, first and second control passages 78, 80 and first and second vent passages 82, 84.

The first exhaust passage 70 may extend from the first valve housing 58 to the second valve housing 60 and the second exhaust passage 72 may extend from the second valve housing 60 to the second fluid chamber 66. The first control passage 78 may extend from the second valve housing 60 to the first fluid chamber 64. The first vent passage 82 may extend from the first fluid chamber 64 to a fluid accumulator 86.

The first supply passage 74 may extend from the first valve housing 58 to the third valve housing 62 and the second supply passage 76 may extend from the third valve housing 62 to the third fluid chamber 68. The second control passage 80 may extend from the third valve housing 62 to the third fluid chamber 68. The second vent passage 84 may extend from the third fluid chamber 68 to the fluid accumulator 86.

The piston 42 may be axially secured to the engine valve 36 and located within the housing 40. In the present non-limiting example, the piston 42 cooperates with the housing to define the first, second and third fluid chambers 64, 66, 68. The piston 42 may include a first piston surface 90 exposed to the first fluid chamber 64, a second piston surface 92 exposed to the second fluid chamber 66 and a third piston surface 94 exposed to the third fluid chamber 68. The first piston surface 90 and the second piston surface 92 may each face a first axial direction (A1) and the third piston surface 94 may face a second axial direction (A2) opposite the first axial direction (A1). The first axial direction (A1) may be the closing direction for the engine valve 36 illustrated in FIG. 4 and the second axial direction (A2) may be the opening direction for the engine valve 36 illustrated in FIG. 5.

The supply control valve 44 may be located in the first valve housing 58 and may be in communication with a first hydraulic fluid supply 96 operating at a first pressure (P1) and a second hydraulic fluid supply 97 operating at a second pressure (P2) less than the first pressure (P1). The second hydraulic fluid supply 97 may form a fluid reservoir. The supply control valve 44 may be an electronically controlled valve. More specifically, the supply control valve 44 may include a spool valve 98, a solenoid 100 engaged with the spool valve 98 and a biasing member 102 engaged with the spool valve 98. The supply control valve 44 may be displaceable between a valve opening position and a valve closing position. More specifically, the solenoid 100 may be commanded to the valve opening position by a control module 104 to displace the spool valve 98 against the biasing member 102 and provide communication between the first hydraulic fluid supply 96 and the first exhaust passage 70 and the first supply passage 74.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

The closing control valve 46 may be located between the supply control valve 44 and the second fluid chamber 66 and may be in communication with the first fluid chamber 64, the second fluid chamber 66 and the supply control valve 44. The closing control valve 46 may control fluid flow from the second fluid chamber 66 to the supply control valve 44 and may be located in the second valve housing 60. The closing control valve 46 may be a mechanical pressure actuated valve and may include a first spool valve 106 and a first biasing member 108.

The first spool valve 106 may have a first end 110 in communication with the first fluid chamber 64 via the first control passage 78 and a second end 112 engaged with the first biasing member 108. The first biasing member 108 may force the first spool valve 106 to a first spool open position and provide a first flow path 114 between the supply control valve 44 and the second fluid chamber 66. The first flow path 114 may be defined by the first and second exhaust passages 70, 72 and the second valve housing 60.

The opening control valve 48 may be located between the supply control valve 44 and the second fluid chamber 66 and may be in communication with the second fluid chamber 66, the third fluid chamber 68 and the supply control valve 44. The opening control valve 48 may control fluid flow from the supply control valve 44 to the second fluid chamber 66 and may be located in the third valve housing 62. The opening control valve 48 may be a mechanical pressure actuated valve and may include a second spool valve 116 and a second biasing member 118.

The second spool valve 116 may have a first end 120 in communication with the third fluid chamber 68 via the second control passage 80 and a second end 122 engaged with the second biasing member 118. The second biasing member 118 may force the second spool valve 116 to a second spool open position and provide a second flow path 124 between the supply control valve 44 and the second fluid chamber 66. The second flow path 124 may be defined by the first and second supply passages 74, 76 and the third valve housing 62.

The first vent valve 50 may be in communication with the first fluid chamber 64 and may be displaceable between a first open vent position and a first closed vent position. The first vent valve 50 may provide communication between the first fluid chamber 64 and a region of the hydraulically actuated valve assembly (fluid accumulator 86) operating at a pressure less than the first pressure (P1) when in the first open vent position. The first vent valve 50 may isolate the first fluid chamber 64 from the fluid accumulator 86 when in the first closed vent position. In the present non-limiting example, the first vent valve 50 is located in the first vent passage 82.

The second vent valve 52 may be in communication with the third fluid chamber 68 and may be displaceable between a second open vent position and a second closed vent position. The second vent valve 52 may provide communication between the third fluid chamber 68 and a region of the hydraulically actuated valve assembly (fluid accumulator 86) operating at a pressure less than the first pressure (P1) when in the second open vent position. The second vent valve 52 may isolate the third fluid chamber 68 from the fluid accumulator 86 when in the second closed vent position. In the present non-limiting example, the second vent valve 52 is located in the second vent passage 84. The fluid accumulator 86 may operate at a pressure lower than the first hydraulic fluid supply 96.

The control module 104 may additionally be in communication with the first and second vent valves 50, 52 and may control opening of the first and second vent valves 50, 52 to adjust engine valve opening and closing as discussed below.

The first check valve 54 may be located in the first flow path 114 and may prevent flow from the second fluid chamber 66 to the supply control valve 44. The second check valve 56 may be located in the second flow path 124 and may prevent flow from the supply control valve 44 to the second fluid chamber 66. In the present non-limiting example, the first check valve 54 is located in the second exhaust passage 72 and the second check valve 56 is located in the second supply passage 76. However, it is understood that the first check valve 54 may be located in the first exhaust passage 70 and the second check valve 56 may be located in the first supply passage 74.

During operation, the engine valve 36 may be displaced between the engine valve closed position (FIG. 2) and the engine valve open position (FIG. 3) by the supply control valve 44. The engine valve 36 may be held in an intermediate position during engine valve opening and closing by the first and second vent valves 50, 52. The transition of the closing control valve 46 and the opening control valve 48 may control the opening and closing profile of the engine valve 36. The closing control valve 46 and the opening control valve 48 may be operated independently from one another.

More specifically, the supply control valve 44 may provide fluid communication between the first hydraulic fluid supply 96 and the first spool valve 106 when in the valve opening position. The supply control valve 44 may provide fluid communication between the second hydraulic fluid supply 97 and the second spool valve 116 when in the valve closing position.

In the present non-limiting example, the first vent valve 50 is in the first open vent position and the supply control valve 44 is in the valve closing position to allow displacement of the engine valve 36 to the engine valve closed position by the valve spring 38. The supply control valve 44 may provide communication between the second fluid chamber 66 and the second hydraulic fluid supply 97 during closing of the engine valve 36.

Figure 4:
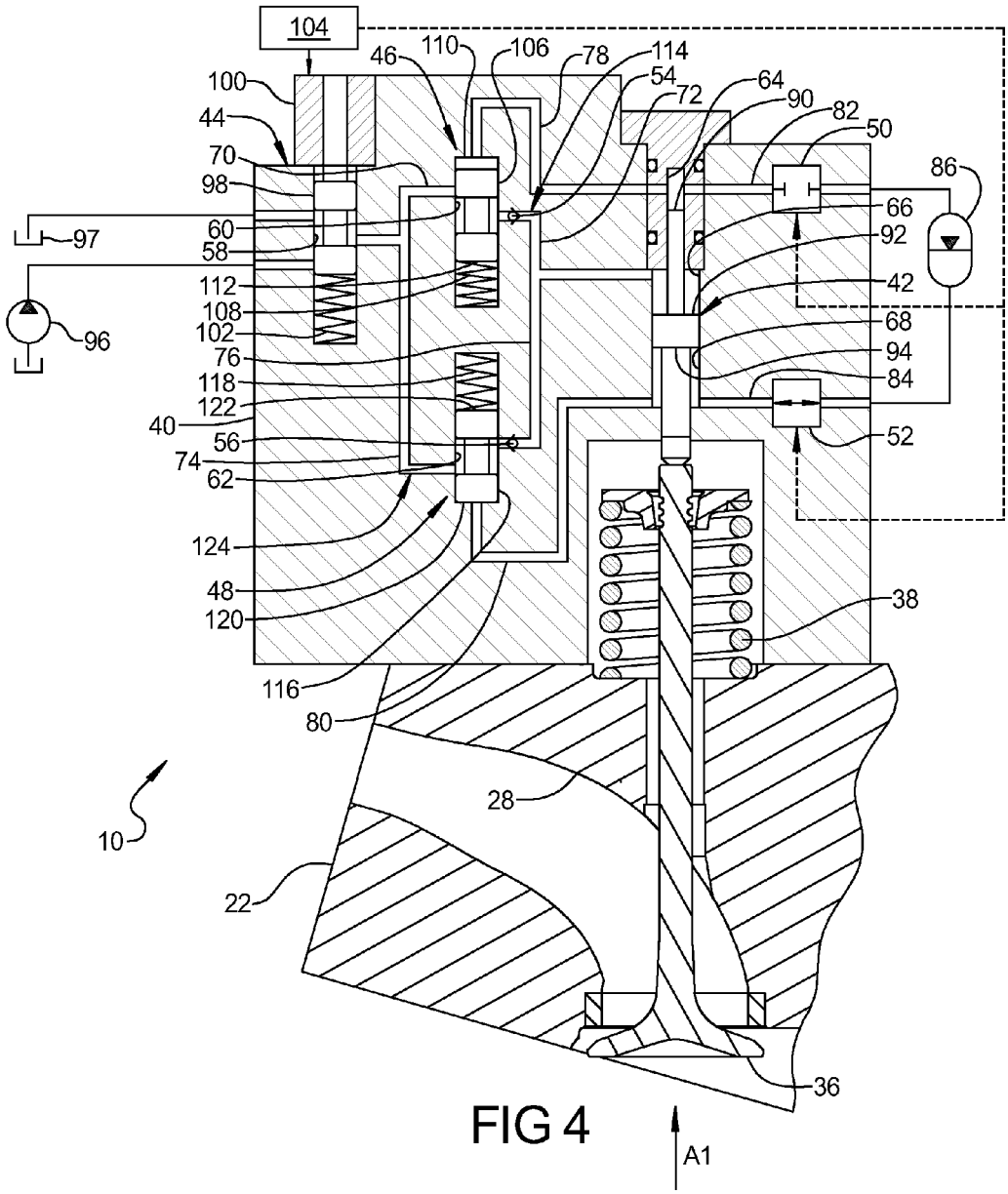
FIG. 4 is an additional section view of the engine assembly of FIG. 1.

As seen in FIG. 4, the fluid supply control valve 44 may be in the valve closing position and the first vent valve 50 may be in the first closed vent position to hold the engine valve 36 in an intermediate engine valve open position during displacement of the engine valve 36 from the engine valve open position to the engine valve closed position (valve closing indicated by A1). The engine valve 36 may be displaced when the first vent valve 50 is in the first closed vent position until hydraulic fluid from the first fluid chamber 64 forces the first spool valve 106 to a first spool closed position where the first flow path 114 is closed.

The closing control valve 46 may provide a transition from the engine valve open position to the intermediate engine valve open position. Similarly, the first vent valve 50 and the closing control valve 46 may be used to control a closing transition of the engine valve 36 from the engine valve open position (or intermediate engine valve open position) to the engine valve closed position.

In the present non-limiting example, the second vent valve 52 is in the second open vent position and the supply control valve 44 is in the valve opening position to provide the first hydraulic fluid supply 96 to the second fluid chamber 66 and displace the engine valve 36 from the engine valve closed position to the engine valve open position. The engine valve 36 may be stopped at an intermediate engine valve open position by the send vent valve 52.

Figure 5:
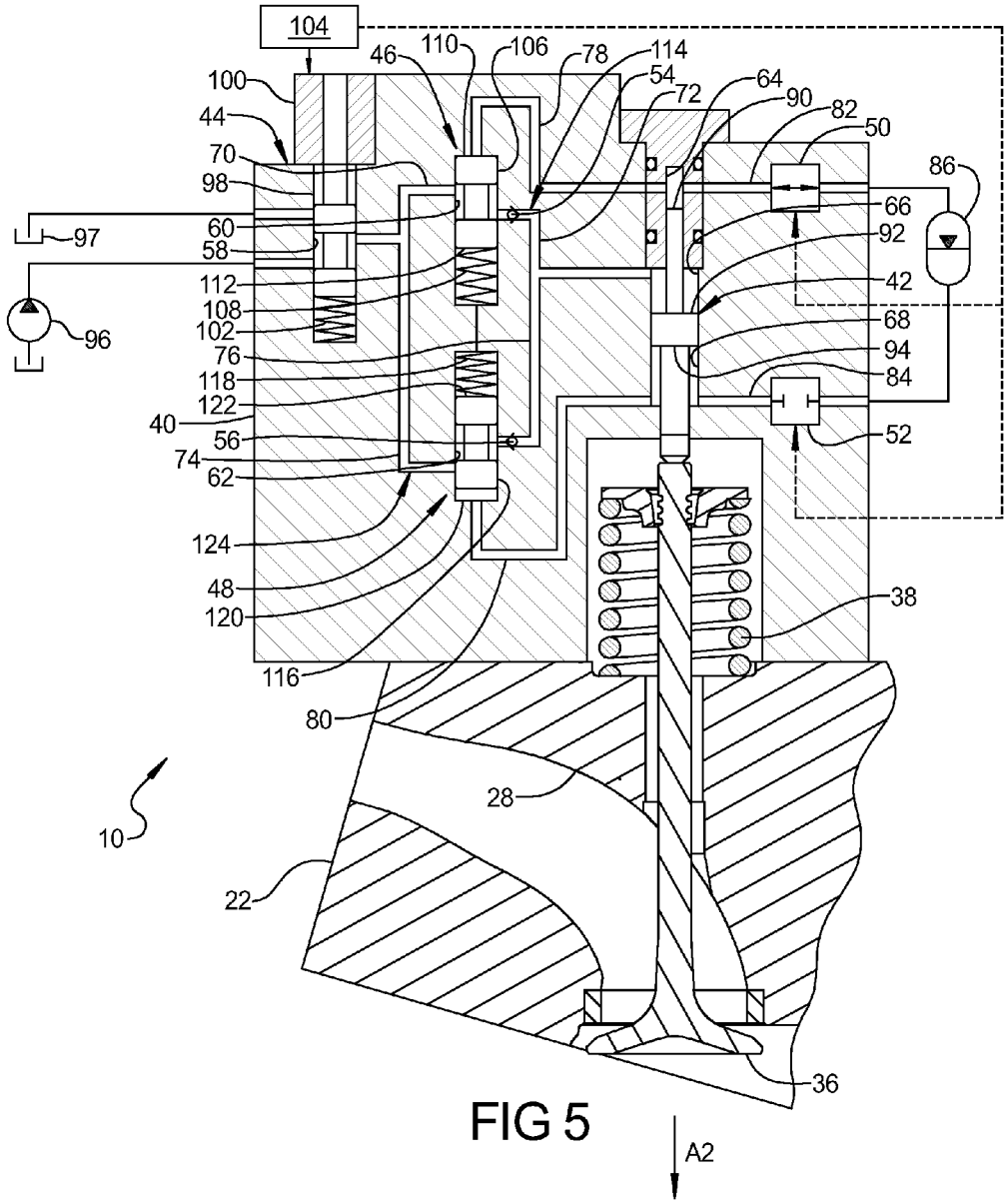
FIG. 5 is an additional section view of the engine assembly of FIG. 1.

As seen in FIG. 5, the supply control valve 44 may be in the valve opening position and the second vent valve 52 may be in the second closed vent position to hold the engine valve 36 in an intermediate engine valve open position during displacement of the engine valve 36 from the engine valve closed position to the engine valve open position (valve opening indicated by A2). The engine valve 36 may be displaced when the second vent valve 52 is in the second closed vent position until hydraulic fluid from the second fluid chamber forces the second spool valve 116 to a second spool closed position where the second flow path 124 is closed.

The opening control valve 48 may provide a transition from the engine valve open position to the intermediate engine valve open position. Similarly, the second vent valve 52 and the opening control valve 48 may be used to control a closing transition of the engine valve 36 from the engine valve closed position (or intermediate engine valve open position) to the engine valve open position.

What is claimed is:

1. A hydraulic valve actuation assembly comprising:

a housing defining a first fluid chamber, a second fluid chamber, and a third fluid chamber;

a piston axially secured to an engine valve and located within the housing and including a first piston surface exposed to the first fluid chamber, a second piston surface exposed to the second fluid chamber and a third piston surface exposed to the third fluid chamber;

a supply control valve in communication with a first hydraulic fluid supply operating at a first pressure and a second hydraulic fluid supply operating at a second pressure less than the first pressure;

a closing control valve located between the supply control valve and the second fluid chamber, the closing control valve being in communication with the first fluid chamber, the second fluid chamber and the supply control valve and controlling fluid flow from the second fluid chamber to the supply control valve; and an opening control valve located between the supply control valve and the second fluid chamber, the opening control valve being in communication with the second fluid chamber, the third fluid chamber and the supply control valve and controlling fluid flow from the supply control valve to the second fluid chamber.

2. The hydraulic valve actuation assembly of claim 1, wherein the closing control valve and the opening control valve operate independently from one another.

3. The hydraulic valve actuation assembly of claim 1, wherein the supply control valve is an electronically controlled valve and the closing control valve and the opening control valve are mechanical pressure actuated valves.

4. The hydraulic valve actuation assembly of claim 3, wherein the closing control valve includes a first spool valve and a first biasing member and the opening control valve includes a second spool valve and a second biasing member, the first spool valve having a first end in communication with the first fluid chamber and a second end engaged with the first biasing member, the second spool valve having a first end in communication with the third fluid chamber and a second end engaged with the second biasing member.

5. The hydraulic valve actuation assembly of claim 4, wherein the first biasing member forces the first spool valve to a first spool open position and provides a first flow path between the supply control valve and the second fluid chamber and the second biasing member forces the second spool valve to a second spool open position and provides a second flow path between the supply control valve and the second fluid chamber.

6. The hydraulic valve actuation assembly of claim 5, further comprising a first vent valve and a second vent valve, the first vent valve being in communication with the first fluid chamber and displaceable between a first open vent position and a first closed vent position and the second vent valve being in communication with the third fluid chamber and displaceable between a second open vent position and a second closed vent position, the first vent valve providing communication between the first fluid chamber and a region of the hydraulically actuated valve assembly operating at a pressure less than the first pressure when in the first open vent position and the second vent valve providing communication between the third fluid chamber and a region of the hydraulically actuated valve assembly operating at a pressure less than the first pressure when in the second open vent position.

7. The hydraulic valve actuation assembly of claim 6, wherein the supply control valve is displaceable between a valve opening position and a valve closing position, the valve opening position providing fluid communication between the first hydraulic fluid supply and the first spool valve and the valve closing position providing fluid communication between the second hydraulic fluid supply and the second spool valve.

8. The hydraulic valve actuation assembly of claim 7, wherein the first vent valve is in the first open vent position and the supply control valve is in the valve closing position when a valve spring displaces the engine valve from an engine valve open position to an engine valve closed position, the first vent valve being in the first closed vent position to hold the engine valve in an intermediate engine valve open position during displacement of the engine valve from the engine valve open position to the engine valve closed position, the engine valve being displaced when the first vent valve is in the first closed vent position until hydraulic fluid from the first fluid chamber forces the first spool valve to a first spool closed position where the first flow path is closed.

9. The hydraulic valve actuation assembly of claim 7, wherein the second vent valve is in the second open vent position and the supply control valve is in the valve opening position to provide the first hydraulic fluid supply to the second fluid chamber and displace the engine valve from the engine valve closed position to an engine valve open position, the second vent valve being in the second closed vent position to hold the engine valve in an intermediate engine valve open position during displacement of the engine valve from the engine valve closed position to the engine valve open position, the engine valve being displaced when the second vent valve is in the second closed vent position until hydraulic fluid from the second fluid chamber forces the second spool valve to a second spool closed position where the second flow path is closed.

10. The hydraulic valve actuation assembly of claim 6, further comprising a first check valve and a second check valve, the first check valve located in the first flow path and preventing flow from the second fluid chamber to the supply control valve and the second check valve located in the second flow path and preventing flow from the supply control valve to the second fluid chamber.

11. An engine assembly comprising:

an engine structure defining a combustion chamber;

an engine valve supported by the engine structure and in communication with the combustion chamber; and a hydraulic valve actuation assembly supported on the engine structure and including:

a housing defining a first fluid chamber, a second fluid chamber, and a third fluid chamber;

a piston axially secured to the engine valve and located within the housing and including a first piston surface exposed to the first fluid chamber, a second piston surface exposed to the second fluid chamber and a third piston surface exposed to the third fluid chamber;

a supply control valve in communication with a first hydraulic fluid supply operating at a first pressure and a second hydraulic fluid supply operating at a second pressure less than the first pressure;

a closing control valve located between the supply control valve and the second fluid chamber, the closing control valve being in communication with the first fluid chamber, the second fluid chamber and the supply control valve and controlling fluid flow from the second fluid chamber to the supply control valve; and an opening control valve located between the supply control valve and the second fluid chamber, the opening control valve being in communication with the second fluid chamber, the third fluid chamber and the supply control valve and controlling fluid flow from the supply control valve to the second fluid chamber.

12. The engine assembly of claim 11, wherein the closing control valve and the opening control valve operate independently from one another.

13. The engine assembly of claim 11, wherein the supply control valve is an electronically controlled valve and the closing control valve and the opening control valve are mechanical pressure actuated valves.

14. The engine assembly of claim 13, wherein the closing control valve includes a first spool valve and a first biasing member and the opening control valve includes a second spool valve and a second biasing member, the first spool valve having a first end in communication with the first fluid chamber and a second end engaged with the first biasing member, the second spool valve having a first end in communication with the third fluid chamber and a second end engaged with the second biasing member.

15. The engine assembly of claim 14, wherein the first biasing member forces the first spool valve to a first spool open position and provides a first flow path between the supply control valve and the second fluid chamber and the second biasing member forces the second spool valve to a second spool open position and provides a second flow path between the supply control valve and the second fluid chamber.

16. The engine assembly of claim 15, further comprising a first vent valve and a second vent valve, the first vent valve being in communication with the first fluid chamber and displaceable between a first open vent position and a first closed vent position and the second vent valve being in communication with the third fluid chamber and displaceable between a second open vent position and a second closed vent position, the first vent valve providing communication between the first fluid chamber and a region of the hydraulically actuated valve assembly operating at a pressure less than the first pressure when in the first open vent position and the second vent valve providing communication between the third fluid chamber and a region of the hydraulically actuated valve assembly operating at a pressure less than the first pressure when in the second open vent position.

17. The engine assembly of claim 16, wherein the supply control valve is displaceable between a valve opening position and a valve closing position, the valve opening position providing fluid communication between the first hydraulic fluid supply and the first spool valve and the valve closing position providing fluid communication between the second hydraulic fluid supply and the second spool valve.

18. The engine assembly of claim 17, further comprising a valve spring engaged with the engine valve and biasing the engine valve to an engine valve closed position, the first vent valve being in the first open vent position and the supply control valve being in the valve closing position when the valve spring displaces the engine valve from an engine valve open position to the engine valve closed position, the first vent valve being in the first closed vent position to hold the engine valve in an intermediate engine valve open position during displacement of the engine valve from the engine valve open position to the engine valve closed position, the engine valve being displaced when the first vent valve is in the first closed vent position until hydraulic fluid from the first fluid chamber forces the first spool valve to a first spool closed position where the first flow path is closed.

19. The engine assembly of claim 17, further comprising a valve spring engaged with the engine valve and biasing the engine valve to an engine valve closed position, the second vent valve being in the second open vent position and the supply control valve being in the valve opening position to provide the first hydraulic fluid supply to the second fluid chamber and displace the engine valve from the engine valve closed position to an engine valve open position, the second vent valve being in the second closed vent position to hold the engine valve in an intermediate engine valve open position during displacement of the engine valve from the engine valve closed position to the engine valve open position, the engine valve being displaced when the second vent valve is in the second closed vent position until hydraulic fluid from the second fluid chamber forces the second spool valve to a second spool closed position where the second flow path is closed.

20. The engine assembly of claim 16, further comprising a first check valve and a second check valve, the first check valve located in the first flow path and preventing flow from the second fluid chamber to the supply control valve and the second check valve located in the second flow path and preventing flow from the supply control valve to the second fluid chamber.

* * * * *